US006991146B2

(12) United States Patent
Sinisi et al.

(10) Patent No.: US 6,991,146 B2
(45) Date of Patent: Jan. 31, 2006

(54) STAPLER HAVING DETACHED BASE

(75) Inventors: John J. Sinisi, Warminster, PA (US); Jennifer W. Sinisi, Warminster, PA (US)

(73) Assignee: Design Circle, Inc., Warminster, PA (US)

( * ) Notice: Subject to any disclaimer, the term of this patent is extended or adjusted under 35 U.S.C. 154(b) by 0 days.

(21) Appl. No.: 10/277,375

(22) Filed: Oct. 22, 2002

(65) Prior Publication Data

US 2003/0178464 A1 Sep. 25, 2003

Related U.S. Application Data

(60) Provisional application No. 60/367,101, filed on Mar. 25, 2002.

(51) Int. Cl.
*B25C 1/02* (2006.01)

(52) U.S. Cl. ..... 227/134; 227/113; 227/119; 227/120; 227/155

(58) Field of Classification Search ..... 227/113, 227/119, 120, 128, 134, 155, 156
See application file for complete search history.

(56) References Cited

U.S. PATENT DOCUMENTS

| | | | | | |
|---|---|---|---|---|---|
| 2,139,342 | A | * | 12/1938 | Wheeler | 227/134 |
| 2,378,725 | A | * | 6/1945 | Paul | 227/155 |
| 2,973,519 | A | | 3/1961 | Jopp | |
| 4,491,261 | A | | 1/1985 | Mitsuhashi | 227/76 |
| 4,496,091 | A | | 1/1985 | Yasuda | 227/123 |
| 4,506,819 | A | | 3/1985 | Rand | 227/120 |
| 4,616,774 | A | | 10/1986 | Yasuda | 227/113 |
| 4,706,866 | A | | 11/1987 | Ebihara | 227/120 |
| 4,727,610 | A | | 3/1988 | Lin | 7/160 |
| 4,838,470 | A | | 6/1989 | Chang | 227/120 |
| 4,925,082 | A | | 5/1990 | Kim | 227/120 |
| 4,927,067 | A | | 5/1990 | Leszczak | 227/128 |
| 4,981,245 | A | * | 1/1991 | Sato | 227/78 |
| 5,509,595 | A | * | 4/1996 | Ho | 227/119 |
| 5,690,268 | A | * | 11/1997 | Evans et al. | 227/156 |
| 5,797,535 | A | * | 8/1998 | Lovegrove et al. | 227/120 |
| 5,857,608 | A | | 1/1999 | Liau | 227/134 |
| 5,992,724 | A | | 11/1999 | Snyder | 227/120 |
| 6,076,720 | A | | 6/2000 | Deng | 227/109 |
| 6,349,868 | B1 | * | 2/2002 | Mattingly et al. | 227/134 |
| 6,386,418 | B1 | * | 5/2002 | Garner | 227/133 |

* cited by examiner

*Primary Examiner*—Louis K. Huynh
*Assistant Examiner*—Chukwurah Nathaniel
(74) *Attorney, Agent, or Firm*—Gregory J. Gore

(57) ABSTRACT

A stapler having a detached base supporting an anvil and a first magnetic element, and a stapling assembly for ejecting staples from a magazine port. The stapling assembly supports a second magnetic element positioned for magnetic coupling to the base to align the anvil with the magazine port. Accordingly, the staple-driving stapling assembly and detached anvil-supporting base are not mechanically coupled. Instead, the stapling assembly and base are magnetically couplable. The magnetic coupling feature eliminates throat depth limitations and allows for staple placement at any desired location on a sheet of any size. An alignment guide may be provided to visually indicate an approximate location where a driven staple will be placed. The base and stapling assembly may be provided with friction pads for limiting movement of any sheets therebetween while stapling.

17 Claims, 6 Drawing Sheets

FIG.1
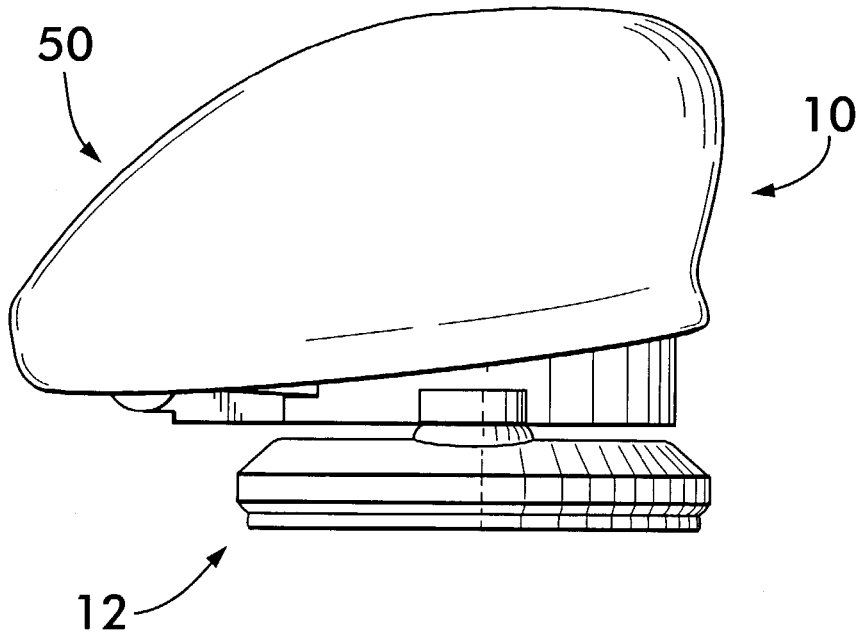
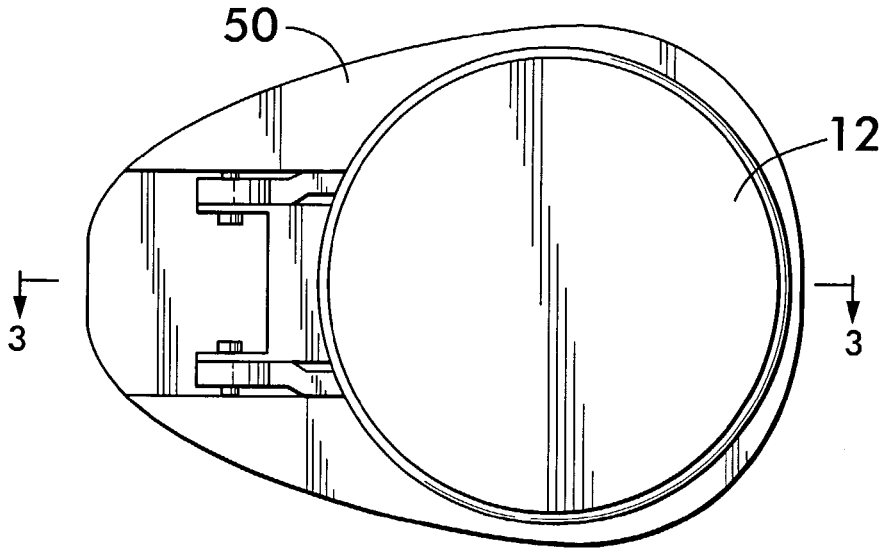
FIG.2

FIG. 6
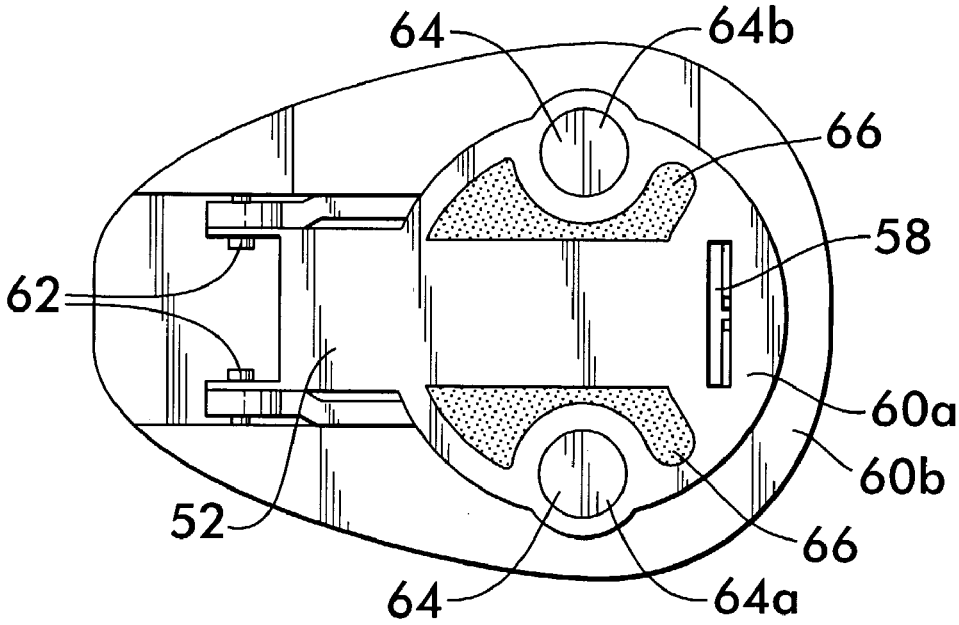
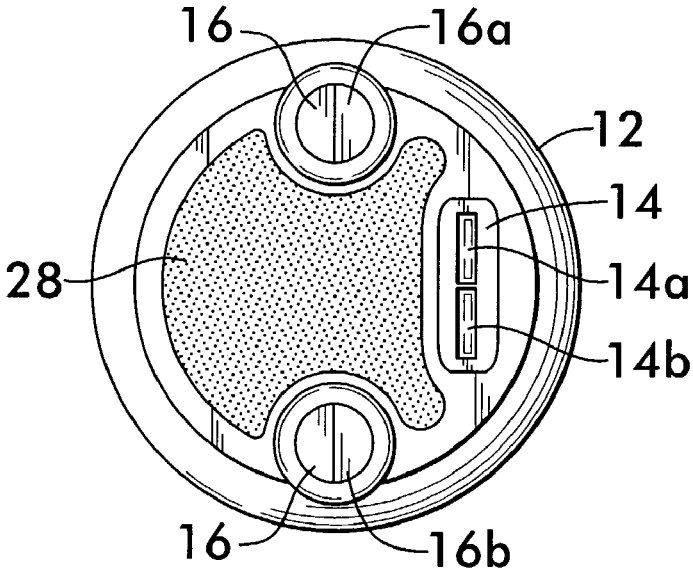
FIG. 7

FIG.8
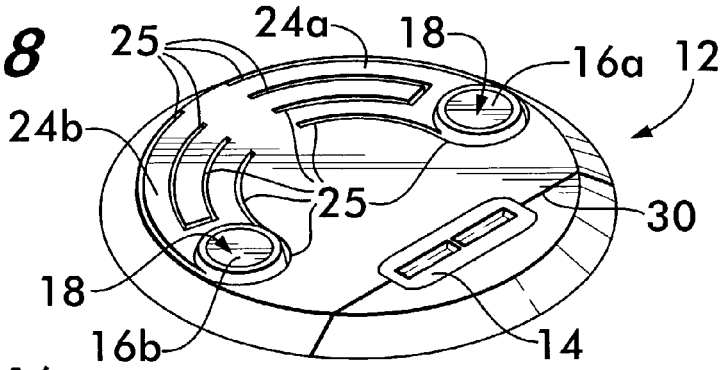
FIG.9
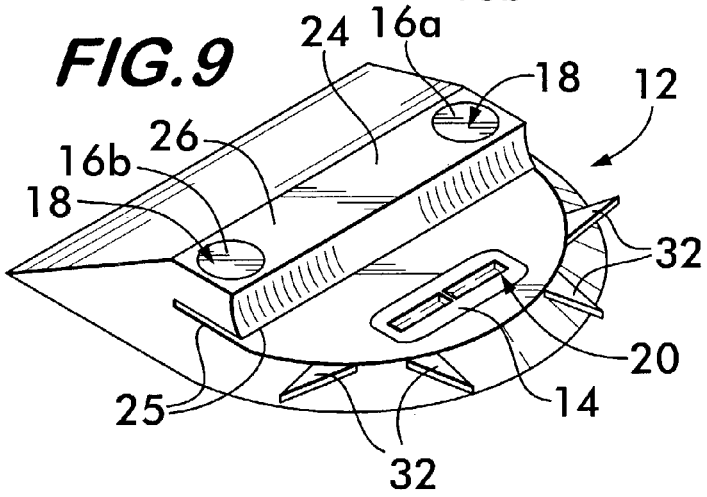
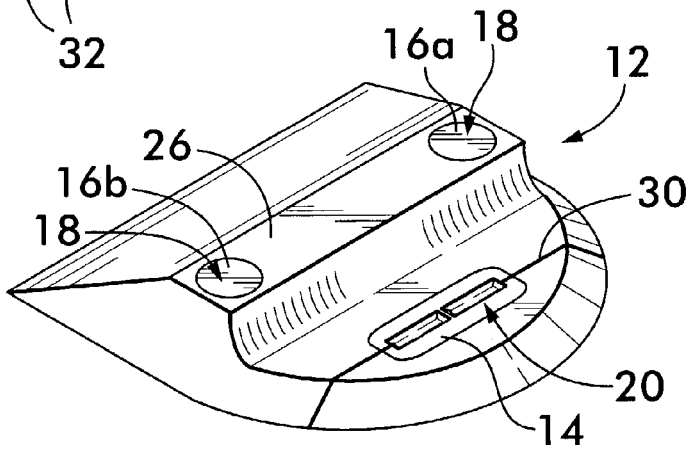
FIG.10
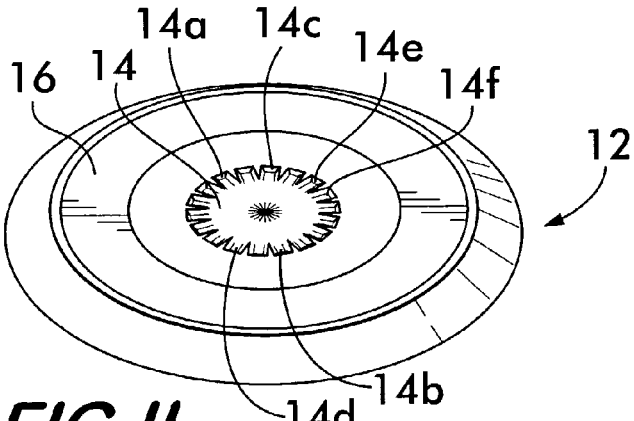
FIG.11

STAPLER HAVING DETACHED BASE

CROSS-REFERENCE TO RELATED APPLICATION

This application claims the benefit of U.S. Provisional Patent Application No. 60/367,101, filed Mar. 25, 2002, the disclosure of which is hereby incorporated herein by reference.

FIELD OF THE INVENTION

The present invention relates generally to staplers for attaching a plurality of sheets of paper, or the like, to each other or to a surface, and particularly to a hand-operated stapler having a detached base.

BACKGROUND OF THE INVENTION

Staplers using wire staples for attaching sheets of paper and other similar materials together are common in corporate, institutional, and educational environments. Manually operated and electrically powered staplers are well known and in widespread use. Exemplary manual staplers are shown in U.S. Pat. Nos. 2,973,519 to Jopp, 4,491,261 to Mitsuhashi, 4,496,091 to Yasuda, 4,506,819 to Rand and 4,927,067 to Leszczak, the disclosures of which are hereby incorporated herein by reference. These staplers are typical of those well known in the art in that they have an anvil-supporting base and a staple-driving stapling assembly mechanically coupled to the base by a fixed hinge. The stapling assembly is typical of those well known in the art in that they include a magazine pivotally mounted to the base for holding a bar of U-shaped staples interconnected in a readily separable manner, and an upper body including a staple ejector for driving successive staples out of the magazine, through sheets of paper, etc. and against the anvil on the base to crimp the legs of the staple and fasten the sheets.

These and other conventional staplers having a mechanically coupled base and stapling assembly share a disadvantage in that they define a throat between the base and stapling assembly that has a fixed depth. The throat depth limits the distance from the edge of a sheet at which at staple may be placed. In other words, because of the fixed hinge attaching the base and stapling assembly, the anvil and staple ejector can reach inwardly only a limited distance from an edge of a sheet, i.e. to the point at which the edge of the sheet reaches an inner portion of the throat near the fixed hinge.

This limitation is undesirable in some stapling situations, e.g. where there is a desire to perform "saddle stitching" staples in the center of the width of an 11 inch high by 17 inch wide sheet of paper to permit a fold producing a booklet measuring approximately 8-½ inches wide by 11 inches high. Similarly, such conventional staplers are inadequate on large-scale projects, e.g. on posterboard or other relatively large scale projects such as student's art displays, on bulletin boards, on corporate or promotional displays, etc., where large-sized sheets are used. The use of large-sized sheets prohibits stapling at certain locations interior to the edges of the sheets using conventional staplers, and limits stapling to portions of the sheets near the edges.

What is needed is a stapler capable of stapling sheets at any desired location, including interior locations of relatively large-scale sheets.

SUMMARY OF THE INVENTION

The present invention provides a stapler having a staple-driving stapling assembly and a detached anvil-supporting base that are magnetically couplable. The magnetic coupling feature eliminates throat depth limitations caused by the fixed hinge of mechanically coupled staplers of the prior art, and allows for staple placement at any desired location on any size of sheet. Additionally, the stapling assembly may be used apart from the anvil-supporting base to drive staples into a bulletin board, etc. when crimping of the staples is not required.

In accordance with the present invention, a stapler with a detached base includes a base supporting an anvil and a first magnetic element, and a stapling assembly for ejecting staples from a magazine port. The stapling assembly supports a second magnetic element positioned for magnetic coupling to the base to align the anvil with the magazine port.

Optionally, the base and/or the stapling assembly includes an alignment guide visually indicating an approximate location where a staple will be placed if driven by the stapling assembly.

In certain embodiments, the base and the stapling assembly are provided with friction pads positioned to cooperatively limit movement of any sheets therebetween while driving a staple from the stapling assembly and against the anvil of the base.

In a particular alternative embodiment, the base is provided with an annular magnet, the anvil being positioned interior to the annular magnet, and the anvil defining a plurality of radially extending crimping surfaces such that the base and stapling assembly may be magnetically coupled and operated to clinch staples in various relative rotational positions.

BRIEF DESCRIPTION OF THE DRAWINGS

FIG. 1 is a side view of a stapler in accordance with an exemplary embodiment of the present invention, showing the stapling assembly magnetically coupled to the base;

FIG. 2 is a bottom view of the stapler of FIG. 1;

FIG. 6 is a bottom view of the stapling assembly of FIG. 1;

FIG. 7 is a top view of the base of FIG. 1;

FIG. 8 is a perspective view of an exemplary base in accordance with an alternative embodiment of the present invention;

FIG. 9 is a perspective view of an exemplary base in accordance with another alternative embodiment of the present invention;

FIG. 10 is a perspective view of an exemplary base in accordance with yet another alternative embodiment of the present invention; and FIG. 11 is a perspective view of an exemplary base in accordance with still another alternative embodiment of the present invention.

DETAILED DESCRIPTION

Figure 3:
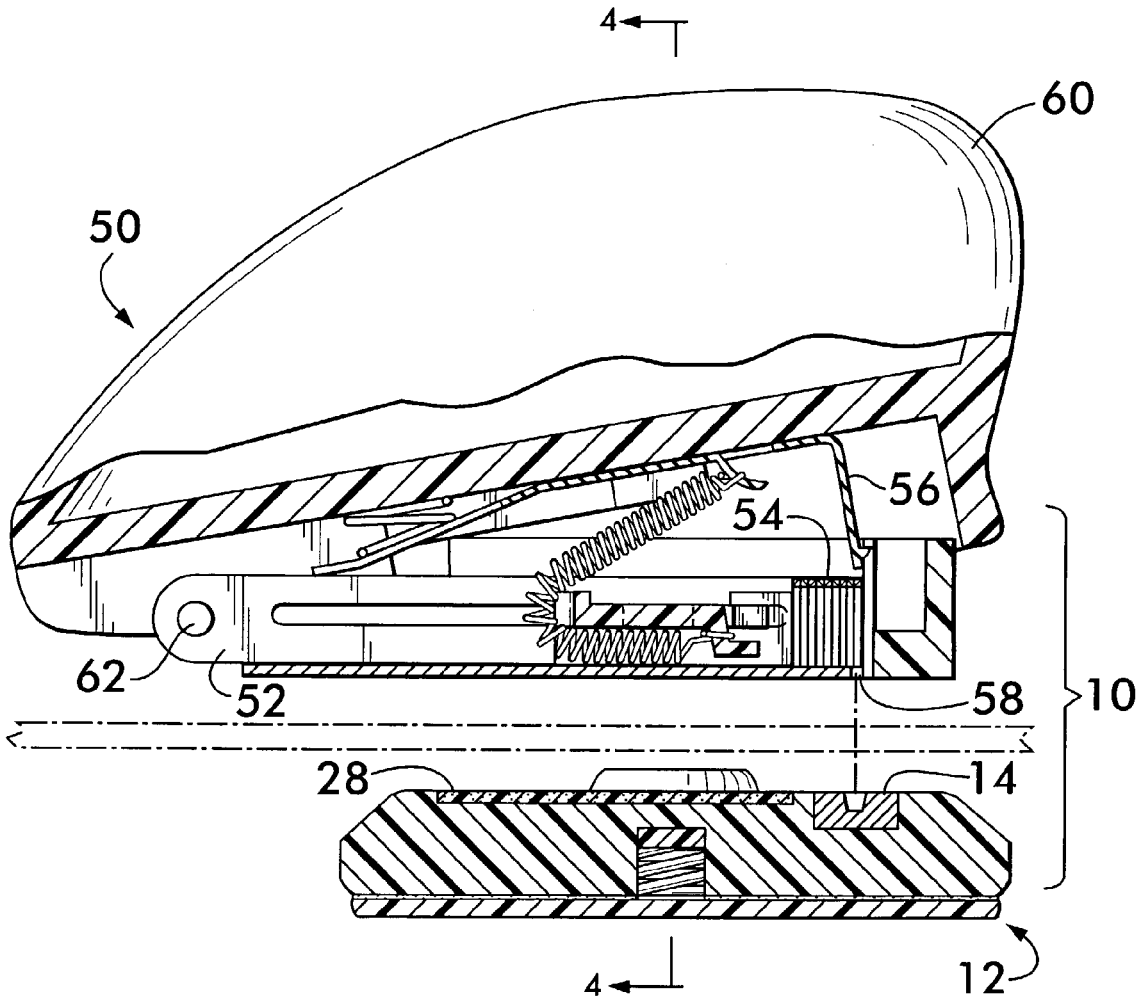
FIG. 3 is sectional view of the stapler of FIG. 1, taken along line 3—3 of FIG. 2.

FIGS. 1–7 show a stapler with detached base in accordance with the present invention. As shown in FIGS. 1 and 3, the stapler 10 includes a base 12 and a stapling assembly 50.

As best shown in FIG. 7, the base 12 supports an anvil 14 defining crimping surfaces 14*a*, 14*b* for crimping staples driven by the stapling assembly 50, as is well known in the art. In accordance with the present invention, the base 12 also supports a first magnetic element. As used herein, the term "magnetic element" includes a member capable of attracting another body by magnetism, as well as a member capable of being attracted to another body by magnetism. For example, a magnetic element may include a natural lodestone or a mass of iron, steel, or alloy that has been artificially magnetized, such as a neodymium magnet. Additionally, a magnetic element may include a mass of iron that is attractable by magnetism.

Figure 4:
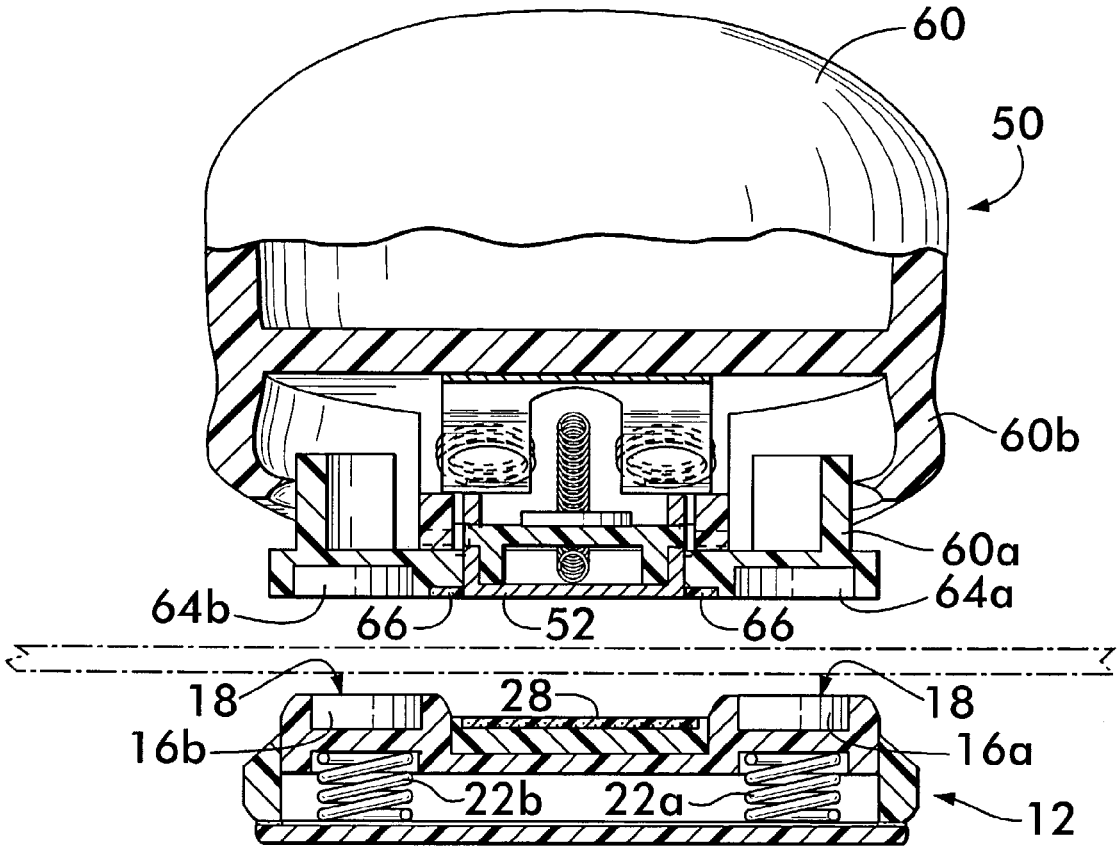
FIG. 4 is a sectional view of the stapler of FIG. 1, taken along line 4—4 of FIG. 3.
Figure 5:
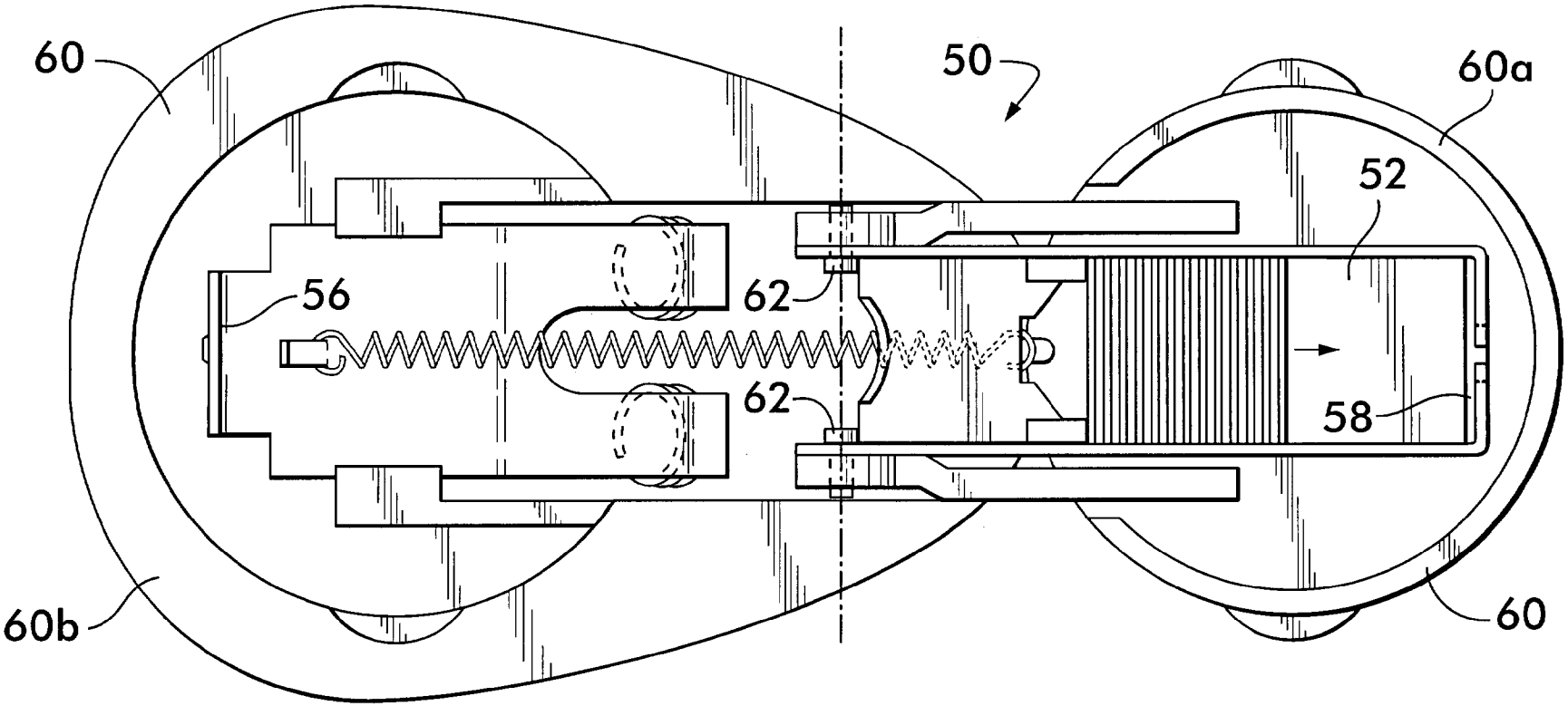
FIG. 5 is a plan view of the stapling assembly of FIG. 1, showing the stapling assembly in an open position.

In the embodiment shown in FIGS. 1–7, the first magnetic element 16 includes first and second permanent magnets 16*a*, 16*b*, such as neodymium magnets, supported on the base 12 in a spaced relationship, as best shown in FIGS. 4 and 7. The use of multiple discrete magnets spaced from one another assists in ensuring proper alignment with the stapling assembly, as discussed in greater detail below. As shown in FIGS. 6 and 7, the magnets 16*a*, 16*b* are positioned on the base 12 along a line extending transversely to a longitudinal axis of a magazine 52 of the stapling assembly 50 when the stapling assembly 50 is coupled to the base 12, as will be discussed further below. Alternatively (not shown), the magnets 16*a*, 16*b* are positioned on the base along a line extending substantially parallel to the longitudinal axis of the magazine.

In a preferred embodiment, the magnets 16*a*, 16 are positioned so that each exposes an opposite magnetic pole for coupling to the stapling assembly. For example, as shown in FIG. 7, magnet 16*a* is positioned on the base to expose its north pole while magnet 16*b* is positioned on the base 12 to expose its south pole. In this manner, coupling of the base and the stapling assembly in a predetermined relationship is ensured, as discussed in greater detail below.

The stapling assembly 50 is configured for ejecting staples from a magazine port, as is well known in the art. Accordingly, the stapling assembly 50 may be of a type generally known in the art. For example, as shown in FIGS. 3–6, the stapling assembly 50 includes a magazine 52 for receiving a bar of staples 54 interconnected in a readily separable manner, and a selectively actuatable ejector 56 for driving successive staples out of the magazine 52 through a magazine port 58. In addition, the stapling assembly 50 may include a handle 60 pivotally mounted to the magazine 52 by pins 62, such that pivotal motion of the handle 60 relative to the magazine 52 actuates the ejector 56 to eject a staple, at which point the handle, magazine and ejector are spring biased to return to their original position. The handle 60 may include a lower handle body 60*a* supporting the magazine 52 and an upper handle body 60*b* pivotally connected to the lower handle body 60*a*. The upper handle body 60*b* supports the ejector 56. This and other suitable arrangements are well known in the art and any suitable arrangement may be used that provides the above-described functionality. Accordingly, the stapling assembly 50 of the present invention functions to receive, store and drive staples like a conventional stapling assembly.

However, in accordance with the present invention, the stapling assembly 50 includes a magnetic element magnetically couplable with the magnetic element 16 on the base 12, as best shown in FIGS. 4 and 6. For example, the magnetic element 64 on the stapling assembly 50 may comprise a magnet, or a member capable of being attracted to a magnet by magnetism. In embodiments in which magnets are disposed on both the stapling assembly 50 and the base 12, each magnet on the stapling assembly 50 is arranged to expose an opposite pole of a corresponding magnet on the base 12. The magnetic element on the stapling assembly 50 is positioned on the stapling assembly 50 for magnetically coupling the base 12 to the stapling assembly 50 to align the anvil 14 with the magazine port 58.

In the embodiment shown in FIGS. 1–7, the magnetic element 64 of the stapling assembly 50 includes third and fourth permanent magnets 64*a*, 64*b*, such as neodymium magnets, supported on the stapling assembly 50 in a spaced relationship corresponding to the spaced relationship of the first and second magnets 16*a*, 16*b* on the base 12. As shown in FIG. 6, the magnets 16*a*, 16*b* and 64*a*, 64*b* are positioned along a line extending transversely to a longitudinal axis of the magazine 52.

In a preferred embodiment, as best shown in FIG. 4, the base 12 further includes spring members 22*a*, 22*b* biasing the first magnets 16*a*, 16*b*, respectively, from a first position in which a contact surface 18 of the first magnets 16*a*, 16*b* is substantially aligned with a plane 20 of the anvil 14 (not shown), to a second position in which the contact surface 18 is spaced from the plane, as shown in FIG. 4. The spring members 22*a*, 22*b* comprise, for example, a pair a coil springs as shown. However, it is understood that any biasing means that will urge the magnets 16*a*, 16*b* upward, e.g. a "living spring," leaf spring, resilient material, etc. may be used as spring members 22*a*, 22*b*. In this manner, the magnets 16*a*, 16*b* are resiliently displaceable from the plane 20 of the anvil 14, to provide clearance for a crimped staple ejected from the stapling assembly 50, as discussed in detail below.

Preferably, as best shown in FIGS. 3, 4, 6 and 7, the base 12 includes a first friction pad 28 and the stapling assembly 50 includes a second friction pad 66. The pads are constructed of a material having a relatively high coefficient of friction, such as rubber or Krayton. The first and second friction pads 28, 66 are positioned to cooperatively hold sheets positioned therebetween to limit movement of the sheets relative to the base 12 and/or stapling assembly 50 while driving a staple from the stapling assembly 50 and against the anvil 14 of the base 12. Each friction pad may include one or more discrete pads.

In accordance with the present invention, the base may have various alternative configurations, as discussed below with reference to FIGS. 8–11. In the alternative embodiments shown in FIGS. 8 and 9, the base 12 is configured with a cantilevered beam for supporting the magnetic element in a similar resiliently displaceable manner. This eliminates the need for spring members 22*a*, 22*b* of FIGS. 1–7. For example, FIG. 8 shows cantilevered beam(s) 24*a*, 24*b*, each of which is integrally formed with the base 12, e.g. by an injection molding or machining process, for supporting magnets 16*a*, 16*b*. The cantilevered beams 24*a*, 24*b* are separated from a portion of the base 12 by slits 25 to allow the cantilevered beams 24*a*, 24*b* to flex relative to the base 12.

In the embodiment shown in FIG. 8, the contact surface 18 of the magnets 16*a*, 16*b* are resiliently displaceable to a position in which the magnets' contact surface 18 is substantially aligned with the plane 20 of the anvil 14, similarly to the embodiment discussed above with reference to FIGS.

1–7. This is particularly advantageous when the magnetic element is positioned relatively close to the anvil, as shown in FIGS. 1 and 8. Accordingly, positive abutting contact between the magnetic elements on the base and the stapling assembly can be maintained throughout the stapling process, while the cantilevered beam resiliently deflects in a pivoting motion.

In the alternative embodiment shown in FIG. 9, the cantilevered beam 24 is provided in the form of a mesa 26 separated from a portion of the base 12 by slits 25. The mesa 26 supports the contact surface 18 of the magnets 16*a*, 16*b* in a position spaced above the plane 20 of the anvil 14. Such a cantilevered beam 24 is particularly advantageous when the magnetic element is positioned relatively far from the anvil, as shown in FIG. 9. Accordingly, positive abutting contact between the magnetic elements on the base and the stapling assembly can be maintained throughout the stapling process, while the cantilevered beam 24, which is integral with the base, resiliently deflects in a pivoting motion to allow the stapling assembly's magazine 52 to move toward the anvil 14.

In the alternative embodiment shown in FIG. 10, the base 12 defines a fixed mesa 26. The mesa 26 supports the contact surface 18 of the magnets 16*a*, 16*b* in a position spaced above the plane 20 of the anvil 14. There is no cantilevered beam supporting the magnets 16*a*, 16*b* on the base 12. In this embodiment, in which the magnetic element is positioned relatively far from the anvil, positive contact between the magnetic elements on the base and the stapling assembly is not maintained throughout the stapling process. Rather, the magnetic elements allow a small separation during stapling to allow the magazine 52 to pivot at the mesa 26 toward the anvil 14.

In another alternative embodiment shown in FIG. 11, the magnetic element 16 mounted on the base 12 (or the stapling assembly 50) comprises an annular magnet, and the anvil 14 is positioned interior to the annular magnet 16 on the base 12. The anvil 14 is configured to define a plurality of radially extending crimping surfaces 14*a*, 14*b*, 14*c*, 14*d*, 14*e*, 14*f*, etc. In this manner, the base 12 and stapling assembly 50 may be magnetically coupled at various relative rotational positions and yet a staple driven from the stapling assembly 50 can be crimped by corresponding crimping surfaces of the anvil 14.

In certain embodiments, the stapler includes an alignment guide visually indicating a location where a staple will be placed if driven by the stapling assembly 50. The alignment guide may have any suitable form. Longitudinal and lateral alignment guides may be provided. For example, a stripe 30 may be painted on or molded into the base 12 or stapling assembly 50, as shown in FIGS. 8 and 10. The stripe may be aligned with the crimping surfaces 14*a*, 14*b* of the anvil 14. Alternatively, the alignment guide may include ears, tabs, etc. 32, as shown in FIG. 9. In another embodiment, at least a portion of the base and/or stapling assembly is constructed of a transparent material to see the anvil, magazine, or alignment guides (not shown). Preferably, the alignment guide is plainly visible when looking downward on the top of the stapling assembly 50.

A stapler 10 according to the present invention may be prepared for use by positioning sheets to be stapled, of any size, over the base 12. The stapling assembly 50, having a bar of staples loaded in its magazine, may then be positioned over the sheets in the approximate location of the base. The magnetic elements of the base 12 and stapling assembly 50 will then cause the base and stapling assembly to magnetically couple with the anvil 14 of the base 12 in alignment with the magazine port 58 of the stapling assembly 50. If desired, the stapler 10 may be repositioned relative to the sheets by sliding the stapling assembly relative to the sheets. The base 12 moves correspondingly to preserve the proper alignment due to the magnetic coupling of the base and stapling assembly. When the stapler 10 is positioned in the desired location, the ejector 56 of the stapling assembly 50 is actuated, e.g. by forcibly urging an upper handle member of the stapling assembly toward the base 12. This causes the ejector to drive a staple from the bar of staples in the magazine 52. The staple exits through the magazine port 58 and passes through the sheets and into the anvil, at which time the legs of the staple are crimped by the crimping surfaces of the anvil to fasten the sheets. During this stapling process, the friction pads, if any, are urged toward the sheets and toward one another to grip and hold the sheets during the stapling process. Additionally, the magnetic elements on the base and/or stapling assembly, if applicable, are resiliently deflected. However, as the stapling assembly 50 returns to a rest position, e.g. by spring biasing as known in the art, the cantilevered beams, and/or spring elements return to their rest positions, causing the sheets to at least partially disengage from the friction pads and to separate the base and anvil and the stapling assembly to provide clearance for the crimped staple fastening the sheets and facilitate movement or removal of the stapler 10 relative to the sheets without tearing the sheets.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A stapler with a detached base comprising:

a base supporting an anvil and a first magnetic element;

a stapling assembly for ejecting staples from a magazine port, said stapling assembly supporting a second magnetic element, said second magnetic element being positioned on said stapling assembly for magnetically coupling said base to said stapling assembly to align said anvil with said magazine port; and a spring member biasing said first magnetic element from a first position in which a contact surface of said first magnetic element is substantially aligned with a plane of said anvil, and a second position in which said contact surface is spaced from said plane.

2. The stapler of claim 1, said stapling assembly comprising:

a magazine for receiving a bar of staples interconnected in a readily separable manner; and a selectively actuatable ejector for driving successive staples out of said magazine through said magazine port.

3. The stapler of claim 2, said stapling assembly further comprising:

a handle movably mounted to said magazine, motion of said handle relative to said magazine actuating said ejector.

4. The stapler of claim 1, wherein said first magnetic element comprises first and second magnets supported on said base in a spaced relationship, and wherein said second magnetic element comprises third and fourth magnets supported on said stapling assembly in a corresponding spaced relationship.

5. The stapler of claim 4, wherein said first and second magnets are positioned to expose opposite magnetic poles for coupling to said stapling assembly.

6. The stapler of claim 1, wherein said base comprises a cantilevered beam and said first magnetic element is supported on said cantilevered beam.

7. The stapler of claim 1, wherein said first magnetic element comprises a first permanent magnet and said second magnetic element comprises a second permanent magnet.

8. The stapler of claim 7, wherein each of said first magnetic element and said second magnetic element comprises a plurality of permanent magnets.

9. The stapler of claim 8, wherein at least two of said plurality of permanent magnets are positioned along a line extending transversely to a longitudinal axis of a magazine of said stapling assembly.

10. The stapler of claim 1, said base further comprising an alignment guide visually indicating an approximate location where a staple will be placed if driven by said stapling assembly.

11. The stapler of claim 1, wherein said second magnetic element is fixed in position relative to a longitudial axis of the stapling assembly.

12. A stapler with a detached base comprising:

a base supporting an anvil and a first magnetic element;

a stapling assembly for ejecting staples from a magazine port, said stapling assembly supporting a second magnetic element, said second magnetic element being positioned on said stapling assembly for magnetically coupling said base to said stapling assembly to align said anvil with said magazine port; and the first magnetic element comprising an annular magnet wherein said anvil is positioned interior to said annular magnet, said anvil defining a plurality of radially extending crimping surfaces.

13. A stapler with a detached base comprising:

a base supporting an anvil and a first magnetic element;

a stapling assembly for ejecting staples from a magazine port, said stapling assembly supporting a second magnetic element, said second magnetic element being positioned on said stapling assembly for magnetically coupling said base to said stapling assembly to align said anvil with said magazine port; and wherein said base comprises a first friction pad and said stapling assembly comprises a second friction pad, said first and second friction pads being positioned on said base and said stapling assembly to cooperatively limit movement of any sheets therebetween while driving a staple from said stapling assembly and against said anvil of said base.

14. A stapler comprising:

a base supporting an anvil and a first magnetic element, said first magnetic element being resiliently biased for displacement from a first position in which a contact surface of said first magnetic element is substantially aligned with a plane of said anvil, and a second position in which said contact surface is spaced from said plane;

a lower handle body supporting a magazine for receiving a bar of staples interconnected in a readily separable manner, said lower handle body supporting a second magnetic element cooperable with said first magnetic element to align said anvil with a port of said magazine;

an upper handle body movably connected to said lower handle body, said upper handle body supporting an ejector for driving successive staples of the bar of staples out of said magazine;

a first friction pad supported on said base; and a second friction pad supported on said lower handle body in position to cooperate with said first friction pad to limit movement of any sheets therebetween while driving a staple from said magazine and against said anvil of said base.

15. The stapler of claim 14, said lower handle body further comprising an alignment guide visually indicating an approximate location where a staple will be placed if driven from said magazine.

16. The stapler of claim 14, wherein said first magnetic element comprises at least two permanent magnets positioned along a line extending transversely to a longitudinal axis of said magazine.

17. The stapler of claim 14, wherein said first magnetic element comprises at least two permanent magnets positioned along a line extending substantially parallel to a longitudinal axis of said magazine.

* * * * *